US006752083B1

(12) United States Patent
Lerche et al.

(10) Patent No.: US 6,752,083 B1
(45) Date of Patent: Jun. 22, 2004

(54) DETONATORS FOR USE WITH EXPLOSIVE DEVICES

(75) Inventors: Nolan C. Lerche, Stafford, TX (US); James E. Brooks, Manvel, TX (US); Kenneth E. Rozek, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/404,522

(22) Filed: Sep. 23, 1999

Related U.S. Application Data

(60) Provisional application No. 60/127,204, filed on Mar. 31, 1999, provisional application No. 60/101,578, filed on Sep. 24, 1998, provisional application No. 60/109,144, filed on Nov. 20, 1998, and provisional application No. 60/101,606, filed on Sep. 24, 1998.

(51) Int. Cl.[7] ..... F42B 3/08

(52) U.S. Cl. ..... 102/202.7; 102/202.5; 102/206; 102/217

(58) Field of Search ..... 102/202.5–202.7, 102/206, 217

(56) References Cited

U.S. PATENT DOCUMENTS

| | | | |
|---|---|---|---|
| 3,181,463 | A | 5/1965 | Morgan et al. |
| 3,327,791 | A | 6/1967 | Harrigan, Jr. |
| 3,366,055 | A | 1/1968 | Hollander, Jr. |
| 3,517,758 | A | 6/1970 | Schuster |
| 3,640,224 | A | 2/1972 | Petrick et al. |
| 3,640,225 | A | 2/1972 | Carlson et al. |
| 3,978,791 | A | 9/1976 | Lemley et al. |
| 4,137,850 | A | 2/1979 | Donner |
| 4,307,663 | A | 12/1981 | Stonestrom |
| 4,393,779 | A | 7/1983 | Brede et al. |
| 4,421,030 | A | 12/1983 | DeKoker |
| 4,421,381 | A | 12/1983 | Barrett |
| 4,441,427 | A | 4/1984 | Barrett |
| 4,471,697 | A | 9/1984 | McCormick et al. |
| 4,517,497 | A | 5/1985 | Malone |
| 4,527,636 | A | 7/1985 | Bordon |
| 4,592,280 | A | 6/1986 | Shores |

(List continued on next page.)

FOREIGN PATENT DOCUMENTS

| | | |
|---|---|---|
| EP | 0 029 671 | 9/1983 |
| EP | 0 601 880 A2 | 6/1994 |
| EP | 0 604 694 A1 | 7/1994 |
| EP | 0 675 262 A1 | 10/1995 |
| GB | 677824 | 8/1952 |
| GB | 693164 | 6/1953 |
| GB | 2118282 | 10/1983 |
| GB | 2100395 | 8/1984 |
| GB | 2190730 | 11/1987 |
| GB | 2226872 | 7/1990 |
| GB | 2265209 | 9/1993 |
| GB | 2290855 | 1/1996 |
| WO | WO 96/23195 | 8/1996 |
| WO | WO 98/38470 | 9/1998 |

OTHER PUBLICATIONS

James E. Brooks, *A Simple Method for Estimating Well Productivity,* Society of Petroleum Engineers 1–8 (Jun. 2–3, 1997).

"Performance Criteria for Small Slapper Detonators" Controller, Her Majesty's Stationery Office, London 1984.

"New Developments in the Field of Firing Techniques" by K. Ziegler Propellants, Explosives, Pyrotechnics 12, 115–120 (1987).

(List continued on next page.)

*Primary Examiner*—Charles T. Jordan
*Assistant Examiner*—Lulit Semunegus
(74) *Attorney, Agent, or Firm*—Trop Pruner & Hu P.C.

(57) ABSTRACT

A detonator assembly for use with explosive devices includes a support structure, an exploding foil initiator mounted on the support structure, and a barrel attached to the support structure and adjacent the exploding foil initiator. The support structure may include a flex cable. An explosive is placed in the proximity of the exploding foil initiator.

45 Claims, 9 Drawing Sheets

U.S. PATENT DOCUMENTS

| | | | |
|---|---|---|---|
| 4,602,565 | A | 7/1986 | MacDonald et al. |
| 4,632,034 | A | 12/1986 | Colle, Jr. |
| 4,638,712 | A | 1/1987 | Chawla et al. |
| 4,662,281 | A | 5/1987 | Wilhelm et al. |
| 4,700,629 | A | 10/1987 | Benson et al. |
| 4,708,060 | A | 11/1987 | Bickes, Jr. et al. |
| 4,729,315 | A | 3/1988 | Proffit et al. |
| 4,735,145 | A | 4/1988 | Johnson et al. |
| 4,762,067 | A | 8/1988 | Barker et al. |
| 4,777,878 | A | 10/1988 | Johnson et al. |
| 4,788,913 | A | 12/1988 | Stroud et al. |
| 4,831,933 | A | 5/1989 | Nerheim et al. |
| 4,843,964 | A | 7/1989 | Bickes, Jr. et al. |
| 4,886,126 | A | 12/1989 | Yates, Jr. |
| 4,944,225 | A | 7/1990 | Barker |
| 5,088,413 | A | 2/1992 | Huber et al. |
| 5,094,166 | A | 3/1992 | Hendley, Jr. |
| 5,094,167 | A | 3/1992 | Hendley, Jr. |
| 5,172,717 | A | 12/1992 | Boyle et al. |
| 5,347,929 | A | 9/1994 | Lerche et al. |
| 5,413,045 | A | 5/1995 | Miszewski |
| 5,505,134 | A | 4/1996 | Brooks et al. |
| 5,520,114 | A | 5/1996 | Guimard et al. |
| 5,539,636 | A | 7/1996 | Marsh et al. |
| 5,706,892 | A | 1/1998 | Aeschbacher, Jr. et al. |
| 5,731,538 | A | 3/1998 | O'Brien et al. |
| 5,756,926 | A | 5/1998 | Bonbrake et al. |

OTHER PUBLICATIONS

"Application of Slapper Detonator Technology to the Design of Special Detonation Systems," by W. H. Meyers Proc. 12$^{th}$ Symposium on Explosives and Pyrotechnics, San Diego, California, Mar. 13–15, 1984, Detonation Systems Development, Los Alamos National Laboratory, pp. 4–5 through 4–19.

"CP DDT Detonators: II. Output Characterization," by M. L. Lieberman Sandia National Laboratories Report SAND 83–1893, Albuquerque, New Mexico, pp. 3–105 through 3–112.

"A Fast, Low Resistance Switch for Small Slapper Detonators," by D. D. Richardson and D. A. Jones Department of Defense Materials Research Laboratories Report MRL–R–1030, Victoria, Australia.

"The Effect of Switch Resistance on the Ringdown of a Slapper Detonator Fireset," by D. D. Richardson Department of Defense Materials Research Laboratories Report MRL–R–1004, Victoria, Australia.

"Flyer Plate Motion and Its Deformation During Flight," by H. S. Yadav and N. K. Gupta Int. J. Impact Engng, vol. 7, No. 1, 1988, pp. 71–83.

"Mossbauer Study of Shock–Induced Effects in the Ordered Alloy $Fe_{50}Ni_{50}$ In Meteorites," By R. B. Scorzelli, I. S. Azevedo, J. Danon and Marc A. Meyers J. Phys. F: Met Phys. 17(1987), pp. 1993–1997.

"Effect of Shock–Stress Duration on the Residual Structure and Hardness of Nickel, Chromel, and Inconel," by L. E. Murr and Jong–Yuh Huang Materials Science and Engineering, 19 (1975), pp. 115–122.

Critical Energy Criterion for the Shock Initiation of Explosives by Projectile Impact, by H. R. James Propellants, Explosives, Pyrotechnics 13, (1988), pp. 35–41.

"High–Temperature–Stable Detonators," by R. H. Dinegar Proc. 12$^{th}$ Symposium on Explosives and Pyrotechnics, San Diego, California, Mar. 13–15, 1984, Los Alamos National Laboratory, pp. 4–1 through 4–4.

"Shock Initiation of PETN," by J. C. Cheng Monsanto Research Corporation, Miamisburg, Ohio, pp. 1–31 through 1–35.

"Exploding Metallic Foils for Slapper, Fuse, and Hot Plasma Applications: Computational Predictions, Experimental Observations," by I. R. Lindemuth, J. H. Brownell, A. E. Greene, G. H. Nickel, T. A. Oliphant and D. L. Weiss, Thermonuclear Applications Group, Applied Theoretical Physics Division, and W. F. Hemsing and I. A. Garcia, Detonation Systems Group, Dynamic Testing Division, Los Alamos National Laboratory, Los Alamos, New Mexico, pp. 229–305.

"A New Kind of Detonator—The Slapper," by J. R. Stroud Lawrence Livermore Laboratory, University of California, Livermore, California, pp. 22–1 through 22–6.

"Pyrotechnic Ignition in Minislapper Devices," by D. Grief and D. Powell Awre, Aldermaston, Reading RG7–4PR, Berkshire, England, Controller, HMSO, London, 1981, pp. 43–1 through 43–10.

"Exploding Foils—The Production of Plane Shock Waves and the Acceleration of Thin Plates," by D. V. Keller & J. R. Penning, Jr. The Boeing Company, Seattle, Washington, pp. 263–277.

"Acceleration of Thin Plates by Exploding Foil Techniques," by A. H. Guenther, D. C. Wunsch and T. D. Soapes Pulse Power Laboratory, Physics Division, Research Directorate Air Force Special Weapons Center, Kirtland Air Force Base, New Mexico, pp. 279–298.

"A Low–Energy Flying Plate Detonator," by A. K. Jacobson Sandia National Laboratories Report, SAND 81–0487C, Albuquerque, New Mexico, 1981, pp. 49–1 through 49–20.

"Sequential Perforations in Boreholes," by H. Lechen ANTARES Datensysteme GmbH, Jan. 1998.

"A Simple Method for Estimating Well Productivity," by J. E. Brooks. SPE European Formation Damage Conference, The Hague, The Netherlands, Jun. 2–3, 1997.

"Unique Features of SCBs," by P. D. Wilcox and "SCB Explosive Studies" by R. W. Bickes, Jr. Initiating and Pyrotechnic Components Division 2515.

DETONATORS FOR USE WITH EXPLOSIVE DEVICES

This application claims priority under 35 U.S.C. §119(e) to U.S. Provisional Patent Application Ser. No. 60/127,204, entitled "Detonators for Use With Explosive Tools," filed Mar. 31, 1999; U.S. Provisional Patent Application Ser. No. 60/101,578, entitled "Initiators Used in Explosive Devices," filed Sep. 24, 1998; U.S. Provisional Patent Application Ser. No. 60/109,144, entitled "Switches for Use in Tools," filed Nov. 20, 1998; and U.S. Provisional Patent Application Ser. No. 60/101,606, entitled "Switches Used in Tools," filed Sep. 24, 1998.

BACKGROUND

The invention relates to detonators for use with explosive devices.

Explosive devices such as shaped charges in perforating guns are commonly used in a well to create openings in a casing section and to extend perforations into a surrounding formation to allow communication of fluids between the formation and the well surface. Explosives may also be used to activate downhole tools, such as packers. Other types of explosive devices include those used in mining operations and other surface applications.

Detonators used with explosive tools are of two general types: electrical and percussion. An electrical detonator may also be referred as an electro-explosive device (EED), which may include hot-wire detonators, semiconductor bridge (SCB) detonators, or exploding foil initiator (EFI) detonators.

An EFI detonator includes an electrically conductive metal foil connected to a source of current. The metal foil includes a narrow neck section that explodes or vaporizes when a high current is discharged quickly through the neck section. The exploding neck section of the foil shears a small flyer from a disk that is disposed in contact with the foil. The flyer travels or flies through a barrel to impact a secondary explosive to initiate a detonation.

A conventional EFI detonator typically includes a capacitor discharge unit of relatively large size, which leads to increased sizes for housings in downhole tools for containing such detonators. Further, because of their relatively large sizes, the efficiencies of conventional EFI detonators are reduced due to increased resistance and inductance of electrical paths in the detonators. As a result, higher voltages and power may be needed for activating such detonators. A need thus continues to exist for improved EFI detonators.

SUMMARY

In general, according to one embodiment, a detonator assembly for use with an explosive device includes a support structure, an exploding foil initiator mounted on the support structure, and at least another component mounted on the support structure. An opening formed in the support structure adjacent the exploding foil initiator, with the opening adapted to receive an initiating element of the exploding foil initiator.

Other features and embodiments will be apparent from the following description, the drawings, and the claims.

DETAILED DESCRIPTION

In the following description, numerous details are set forth to provide an understanding of the present invention. However, it is to be understood by those skilled in the art that the present invention may be practiced without these details and that numerous variations or modifications from the described embodiments may be possible. For example, even though reference is made to detonators according to some embodiments for use with explosive devices such as shaped charges in a perforating gun string, detonators may also be used with other types of explosive devices (e.g., those in other types of downhole tools or tools used in mining operations and other applications) in further embodiments.

Figure 1:
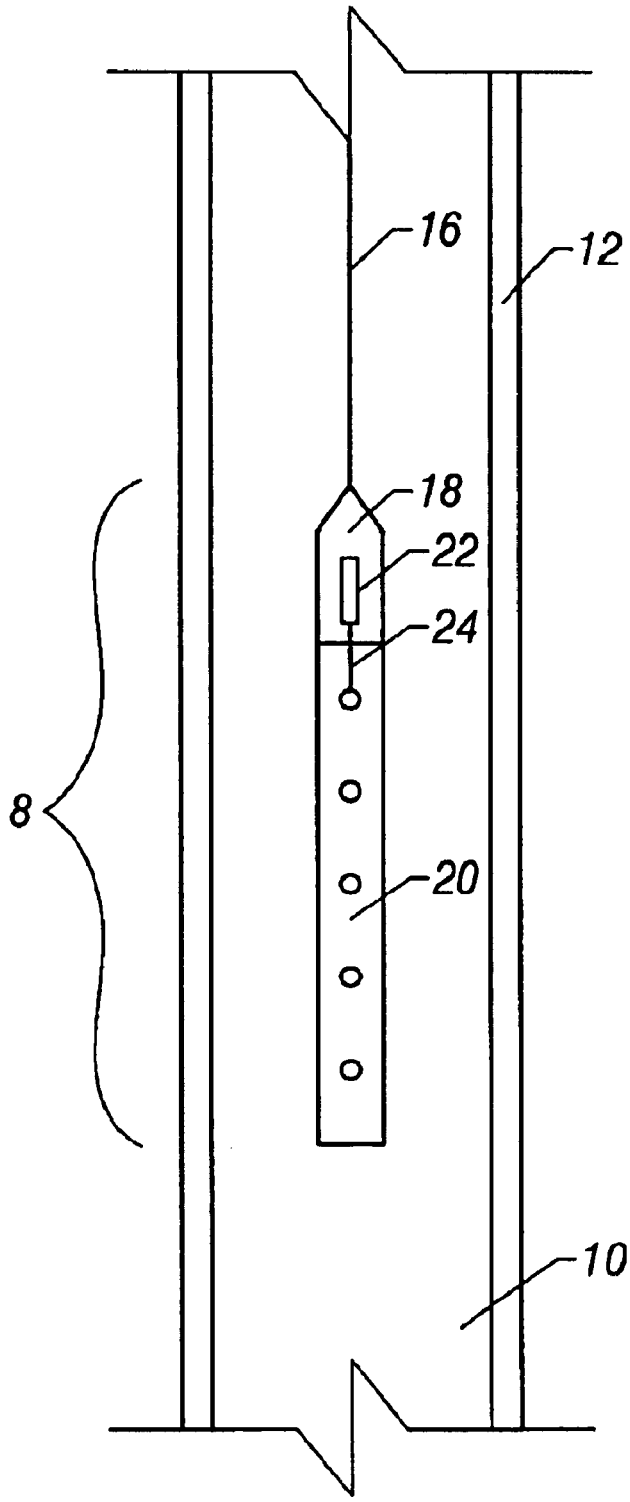
FIG. 1 illustrates a downhole tool including a perforating gun string having a detonator assembly according to one embodiment.

Referring to FIG. 1, an embodiment of a downhole tool 8 includes a perforating string having a perforating gun 20 and a firing head 18. In one embodiment, the perforating string 8 may be attached at the end of an electrical cable 16, which may be a wireline or an electrical cable run through a coiled tubing. The firing head 18 includes an exploding foil initiator (EFI) detonator assembly 22 according to one embodiment. The perforating string 8 is lowered to a desired depth in a wellbore 10 lined with casing 12. In response to an activating signal sent down the electrical cable 16, the EFI detonator assembly 22 is activated to initiate a detonating cord 24 that is attached to shaped charges (not shown) in the perforating gun 20. When fired, perforating jets from the shaped charges extend perforations through the casing 12 into the surrounding formation.

In alternative embodiments, the activating signal may be in the form of pressure pulse signals or hydraulic pressure. In such embodiments, the electrical cable 16 may not be needed, and the downhole tool 8 may be carried by slickline or tubing. Activating power may also be provided by a downhole battery. Further, other embodiments of the downhole tool 8 may include packers, valves, or other devices. Thus, the activating signal may activate control modules to set packers, to open and close valves, or to activate other devices.

Exploding foil initiators may include an exploding foil "flyer plate" initiator or an exploding foil "bubble activated" initiator. In the ensuing description, reference is made to the "flying plate" EFI. However, in further embodiments, other types of EFI may be used, as may other types of electrical initiators such as exploding bridgewire (EBW) initiators and semiconductor bridge (SCB) initiators.

Figure 2:
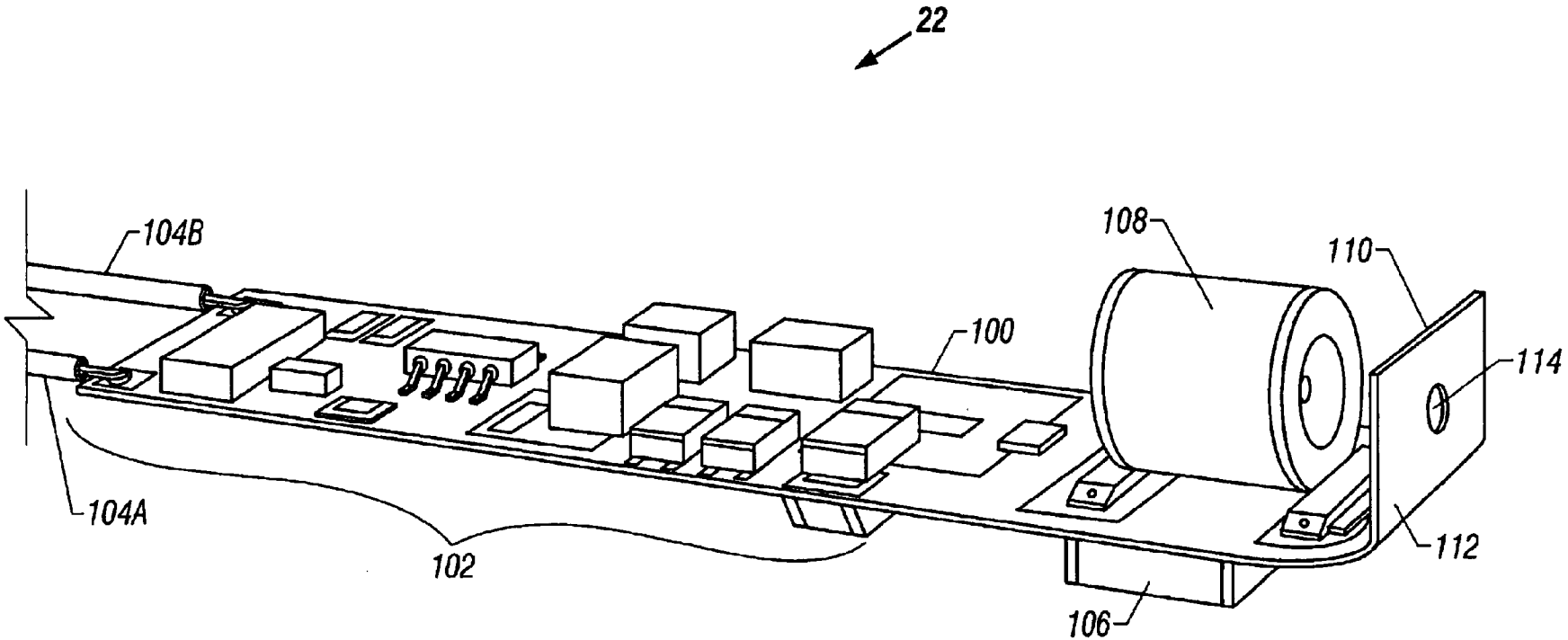
FIGS. 2 and 3 illustrate a multiplier and capacitor discharge unit (CDU) in the detonator assembly of FIG. 1.
Figure 3:
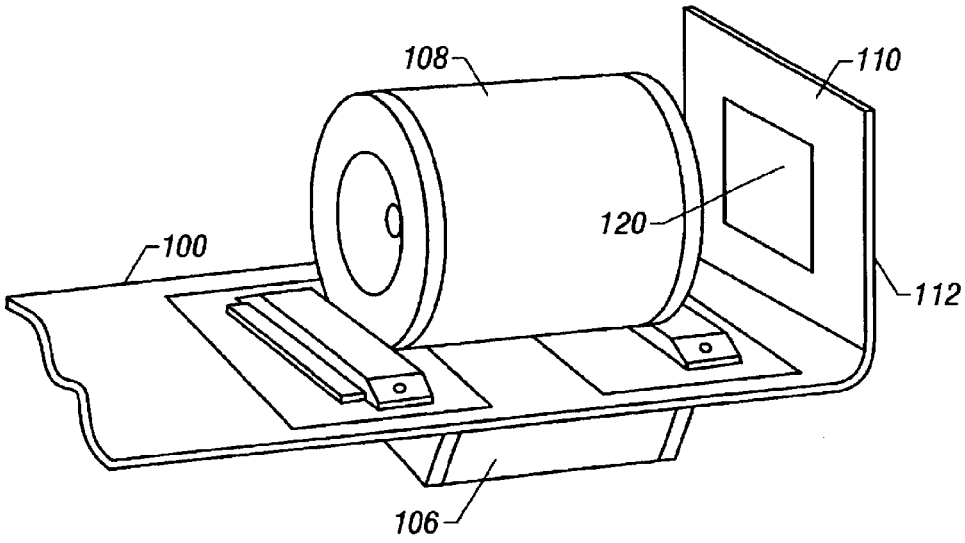

Referring to FIGS. 2 and 3, portions of the detonator assembly 22 according to one embodiment are illustrated. The detonator assembly 22 includes a support structure 100, such as flexible support structures including flex cables or flexible circuits available from various manufacturers, including Sheldohl, E. I. du Pont de Nemours and Company, and International Business Machines Corporation. The support structure 100 may be a multi-layered structure, including metal conductor traces on both sides of an insulation layer (e.g., a polyimide layer such as KAPTON® or Pyralin). A source of Pyralin is Hitachi Chemical DuPont (HD) MicroSystems L.L.C. A source of KAPTON® polyimide film is E.I. du Pont de Nemours and Company.

Conductors 104A and 104B in the electrical cable 16 are electrically connected to conductor traces in the support structure 100. An incoming electrical voltage on conductors 104A and 104B is applied to a multiplier 102, which may be in the form of a DC-to-DC converter, to multiply the input voltage at conductor lines 104A and 104B by some factor (e.g., 2×, 3×, 4×, and so forth). In one example embodiment, the voltage multiplier 102 may include the following components: a 4× power supply, an oscillator, stages of diodes and capacitors for voltage multiplication, and a bleed resistor. The output of the voltage multiplier 102 is provided to a slapper capacitor 106 in an initiator device such as a capacitor discharge unit (CDU), which can be charged to some predetermined voltage, e.g., between about 800–1600 VDC. The other components of the CDU include a switching component 108 and the EFI circuit 120.

The slapper capacitor 106 can be any one of various types of conventional capacitors, including a capacitor having a dielectric formed of a ceramic material, e.g., lead zirconate titanate (PZT). A capacitor with the ceramic dielectric may have a larger capacitance value versus other types of capacitors with the same footprint requirements on the support structure 100.

In the illustrated embodiment, the switching component 108 is mounted on a side of the flexible support structure 100 opposite the capacitor 106. In one example embodiment, the switching component 108 may be a switching spark gap (such as one made by Siemens) that is actuated by an overvoltage condition (e.g., 1,400 VDC). The other end of the spark gap 108 is coupled to an EFI circuit 120. Normally, the switching spark gap 108 is in an open position to isolate the applied electrical cable voltage from the EFI circuit 120. However, when the slapper capacitor 106 is charged to a sufficient overvoltage, e.g., between about 1,200 and 1,600 VDC, the spark gap 108 rapidly conducts and connects the voltage in the slapper capacitor 106 to the EFI circuit 120. In an alternative embodiment, if a miniature spark gap, such as one made by Reynolds Industries, is used, then a voltage above 1,000 VDC at the output of the voltage multiplier 102 may be enough to activate the miniature spark gap.

In further embodiments, the switching component 108 may include other types of switches, including those described in copending Patent Application, entitled "Switches Used in Wells" by Nolan C. Lerche and James E. Brooks, filed concurrently herewith and hereby incorporated by reference. Some of these alternative switches may be activated by even lower voltages at the voltage multiplier 102 output. Other types of switches may also be used in other embodiments, such as switches that are formed on the same substrate as the EFI circuit 120. Switches with lower resistance and inductance may allow lower activation voltages to be directly transmitted down the electrical cable 16.

Figure 9:
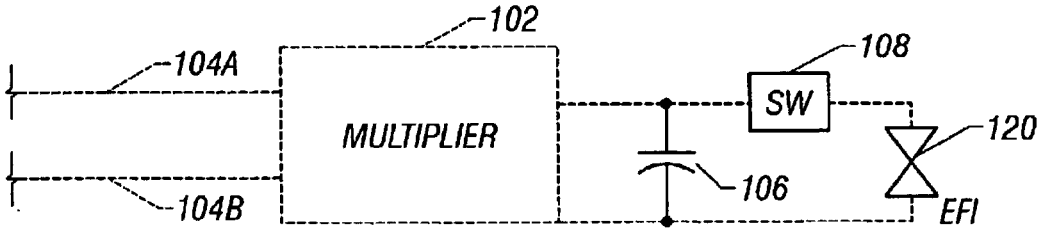
FIG. 9 is an electrical schematic diagram of a portion of the detonator assembly of FIG. 1.

Referring to FIG. 9, an electrical schematic diagram of a portion of the detonator assembly 22 is illustrated. The electrical cable conductors 104A and 104B are routed to inputs of the voltage multiplier 102. The outputs of the voltage multiplier 102 are coupled across the slapper capacitor 106 to charge the capacitor to a predetermined voltage. When a predetermined voltage is reached (in the case of a switching spark gap), or in response to a trigger signal (with some other types of switches), the switch component 108 closes to connect the voltage in the capacitor 106 to the EFI circuit 120.

As shown in FIG. 3, the EFI circuit 120 is mounted on the inside surface 110 of a barrel 112, which is formed from an end of the support structure 100 in accordance with one embodiment of the invention. The support structure 100 thus includes two integral segments, one on which the voltage multiplier 102, capacitor 106, and switch 108 are mounted, and the other on which the EFI circuit 120 is mounted. The first and second segments are arranged at an angle (approximately perpendicular in the illustrated embodiment). In an alternative embodiment, the first and second segments may be separate pieces attached to each other at an angle. The EFI circuit 120 (or some other type of initiator) is arranged in a position of the support structure that is bent or set at some predetermined angle to orient the initiator in a desired direction, such as towards an explosive.

The barrel 112 has an opening 114 through which a flyer can pass through in response to activation of the EFI circuit 120. As illustrated, the barrel 112 is integrally formed with the rest of the support structure 100. This advantageously allows the detonator assembly 22 to be made as a smaller package, e.g., having a length at least as small as about 3.5 inches in one example embodiment. With a bubble activated EFI, the opening 114 provides a path through which the bubble generated by the EFI can expand. Thus, the opening 114 is adapted to receive an initiating element from the EFI, such as a flyer or a bubble.

Another advantage is that the EFI circuit 120 may be electrically coupled closer to the remaining components of the CDU, including the slapper capacitor 106 and the switching component 108. Due to the characteristics of the support structure 100 (e.g., a flex cable) and the close proximity of the components of the CDU, relatively low inductance and resistance exist in the electrical path from the slapper capacitor 106 to the EFI circuit 120. As a result, the slapper capacitor 106 may have a smaller capacitance (e.g., less than 0.1 microfarads or gF) as the transfer of energy is made more efficient from the capacitor 106 to the EFI circuit 120. In another embodiment, instead of using the capacitor 106, another type of energy source may be used to activate the EFI circuit 102.

Figure 4A:
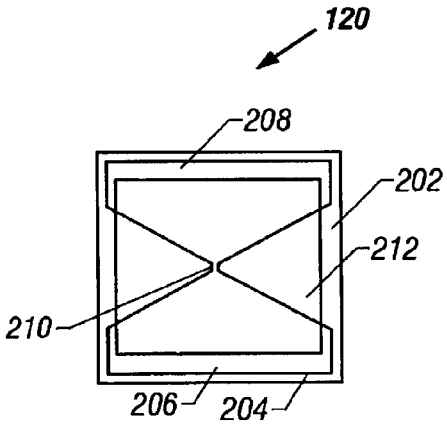
FIG. 4A illustrates an exploding foil initiator (EFI) circuit according to one embodiment in the CDU of FIG. 2.
Figure 4B:
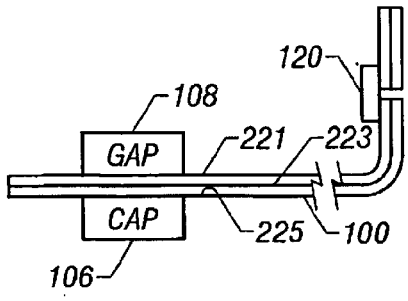
FIG. 4B illustrates a cross-section of a portion of the detonator assembly.

Referring further to FIG. 4B, the voltage multiplier 102, slapper capacitor 106, switching component 108, and EFI circuit 120 can be mounted onto the support structure 100 using a surface mount technology (SMT). As conductive traces are provided on both the upper and lower layers 221 and 225, respectively, of the support structure 100 according to one embodiment, the components may be mounted on both the upper and lower layers to save space and reduce distances between components. An insulation layer 223 is disposed between the upper and lower layers 221 and 225. As noted above, the compact design aids in reduction of inductance and resistance in the conductive traces of the support structure to enhance efficiency of energy transfer.

Referring to FIG. 4A, the EFI circuit 120 according to one embodiment includes a substrate 202 (which may be formed of a ceramic, silicon, or other suitable material) on which a metal foil layer 204 can be formed. The foil 204 may be formed of copper, for example, although other types of electrically conductive metal layers may also be used in further embodiment, such as aluminum, nickel, steel, tungsten, gold, silver, a metal alloy, and so forth. The foil 204 includes two electrode portions 206 and 208 and a reduced neck section 210. Also illustrated in FIG. 4 is a polyimide layer 212 (e.g., KAPTON® or Pyralin) formed over the neck section 210 of the foil 204.

The substrate 202 may be a ceramic material having a thickness of about 25 mils and formed of a material including alumina, for example. To manufacture the EFI circuits, a sheet of ceramic substrate (e.g., about 4 inches by 4 inches in one embodiment) may be used on which a number of metal foils 204 can be deposited. The metal deposition can be performed using sputter deposition or electronic beam deposition. In one embodiment, each metal foil 204 may include three metal layers, including a bottom layer of titanium, a middle layer of copper, and a top layer of gold, as an example. Example thicknesses of the several layers may be as follows: about 500 Angstroms of titanium, about 3 micrometers of copper, and about 500 Angstroms of gold. In one example configuration, the reduced neck section 210 of the foil 204 may be approximately 8 mils by 8 mils in size.

Following deposition of the layer 204, polyimide in flowable form (e.g., Pyralin) may be poured onto the entire top surface of the ceramic substrate 202. A first coat of polyimide may be spun onto the ceramic substrate 202 at a predetermined rotational speed (e.g., about 2,900 rpm) for a predetermined amount of time (e.g., about 30 seconds). The polyimide layer can then be cured by soft baking in a nitrogen environment at a predetermined temperature (e.g., about 90° C.) for some predetermined amount of time (e.g., about 30 minutes). In one embodiment, a second coat of polyimide can be spun onto the ceramic substrate and metal foil 204. In one embodiment, after the polyimide layers have been spun on and cured, a layer of polyimide of about 10 micrometers is formed over the metal foil 204 and ceramic substrate 202. Next, the polyimide layer is selectively etched to remove all portions of the polyimide layer except for the portion 212 above the reduced neck section 210 of the foil 204.

When a sufficiently high voltage is applied across the electrodes 206 and 208 of the metal foil 204, the neck section 210 explodes or vaporizes and goes through a phase change to create a plasma, which causes a portion (referred to as the flyer) of the polyimide layer 212 to be separated from the foil 204 to traverse the opening 114 of the barrel 112. In another embodiment, instead of a polyimide flyer, a composite flyer may be used that is made of a layer of polyimide and a layer of metal (e.g., nickel, tungsten, silver, copper, gold, and so forth).

Figure 5:
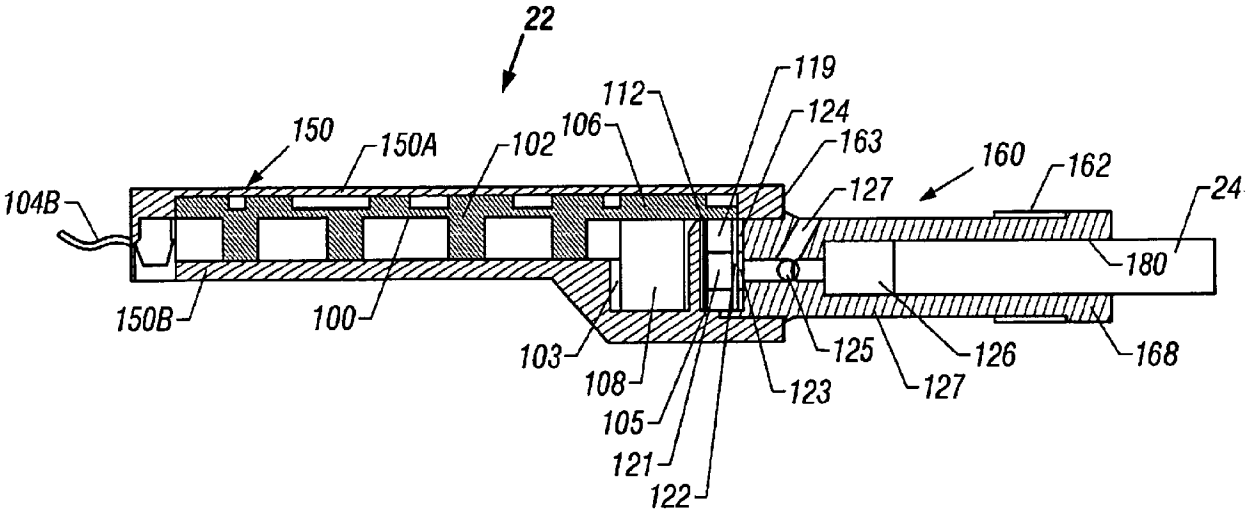
FIG. 5 is a cross-sectional diagram of the detonator assembly of FIG. 1.

Referring further to FIG. 5, the flyer is sent through the barrel 112 to impact a secondary explosive pellet 121, which may be fine particle HNS or NONA, for example. NONA, a special type of fine-particle explosive, may be more sensitive so that a lower firing voltage may be achieved. The secondary explosive pellet 121 may be positioned in the bore of a ring-shaped pellet carrier 119. A thin layer 122, which may be formed of aluminum, for example, may be placed next to and in contact with the secondary explosive 121.

If a "bubble activated" EFI is used instead, a polyimide layer may bubble and expand to impact an explosive. An example "bubble activated" EFI is disclosed in commonly assigned U.S. Pat. No. 5,088,413, by Huber et al., which is hereby incorporated by reference. If a bubble activated initiator is used, the expanding bubble impacts the explosive 121 to start a detonation. Other initiators may be employed for initiating the explosive 121, such as exploding bridgewire (EBW) initiators or semiconductor bridge (SBC) initiators.

Explosion of the secondary explosive 121 causes a portion (also referred to as a flyer) of the thin layer 122 to be sheared and shot through an opening 123 in a shear washer 124. The flyer traverses a gap 125 having a predetermined distance (e.g., about 0.36 inches) to impact a booster explosive 126. Upon impact by the metal flyer, the booster explosive 126 explodes to initiate a detonating cord 24 attached to the booster explosive 126. Initiation of the detonating cord 24 causes a detonating wave to be sent down the detonating cord to shaped charges in the perforating gun 20.

The pellet carrier 119, secondary explosive pellet 121, thin metal layer 122, and shear washer 124 that are part of the detonator assembly 22 are contained inside a booster housing 160. Openings or slots 127 may be provided from outside the booster housing 160 (which may be formed of plastic, for example) to the gap 125 to provide fluid desensitization. In the presence of fluids, such as with a flooded perforating gun 20, the flyer from the layer 122 would be blocked by the fluid and unable to achieve the required speed in the gap 125 to initiate the booster explosive 126. This prevents firing of a flooded gun or detonation of an explosive in another downhole tool that is flooded with well fluid.

Figure 6:
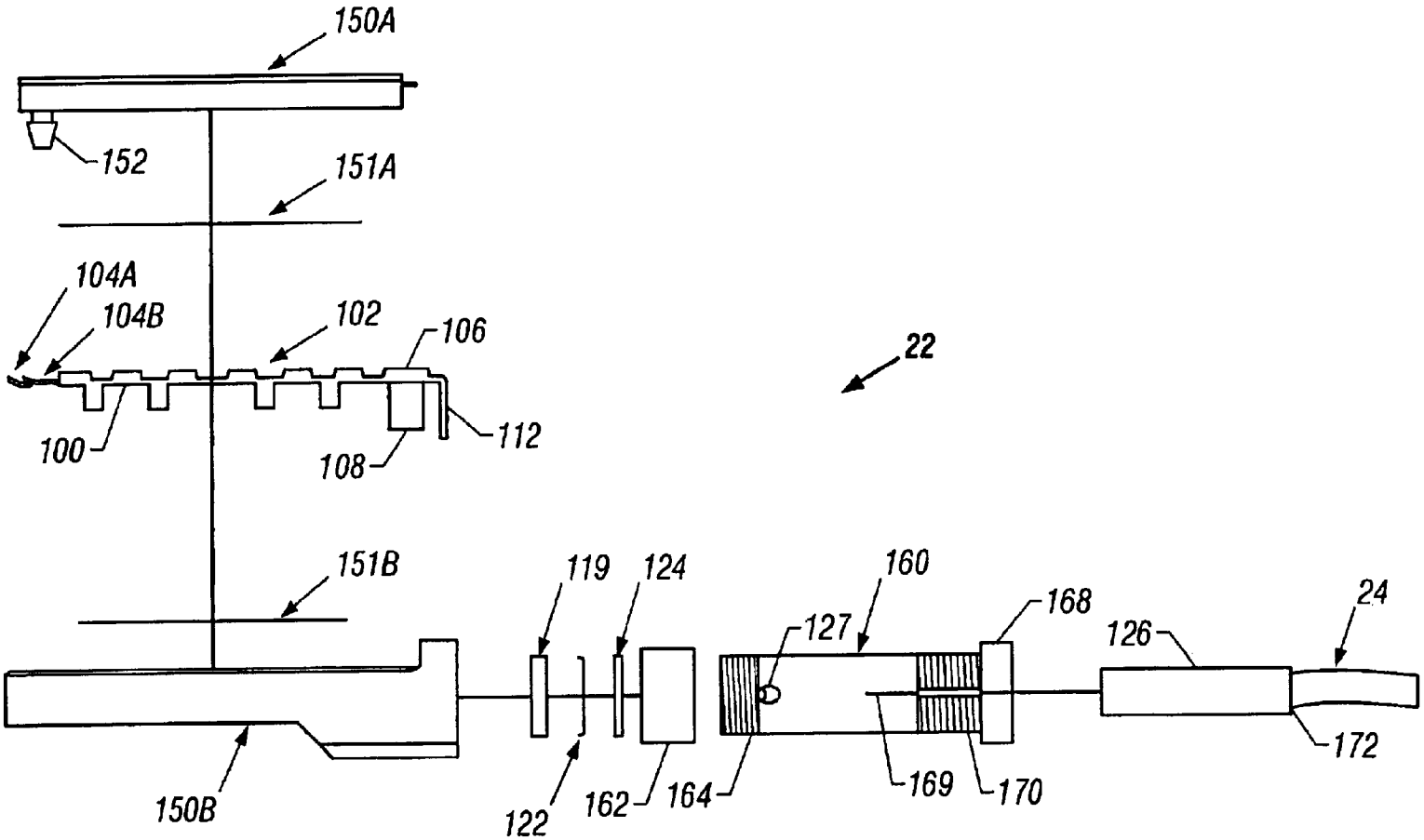
FIG. 6 is an exploded view of the detonator assembly of FIG. 1.

Referring further to FIG. 6, the assembly comprising the electronic circuit (including the voltage multiplier, CDU, and barrel) is enclosed in a main housing 150 (which may be formed of plastic, for example) having a top housing portion 150A and a bottom housing portion 150B. Grooves 103 and 105 (FIG. 5) are formed inside the main housing 150 to receive the switching spark gap 108 and the barrel 112 that is integrally formed with the support structure 100.

In one arrangement, a first pad layer 151B (e.g., formed of silicone rubber) is positioned in the bottom housing portion 150B. The support structure 100 and attached electronic circuitry are placed on the first pad layer 151B. A second pad layer 151A is laid over the upper surface of the components on the support structure 100. The top housing portion 150A covering the support structure and electronic circuitry assembly is attached to the bottom housing portion 150B using an attachment member 152.

In one embodiment, the booster housing 160 containing the pellet carrier 119, the thin layer 122, and the shear washer 124 has a threaded section 164 for threaded attachment to the main housing 150. A pin 163 (FIGS. 5 and 7) may be inserted into the side of threaded housing 150B and driven into the threaded portion 164, thus preventing the booster housing 160 from rotating loose during use. Other attachment mechanisms between the housings 150 and 160 may be employed.

Figure 7:
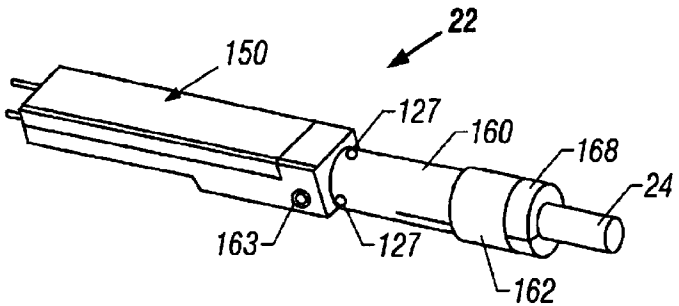
FIG. 7 is a perspective view of the detonator assembly of FIG. 1.

At the other end, the booster housing 160 includes a latch section in which the housing 160 is split into segments 168 with slits 169 separating the segments 168 to allow the generally cylindrical booster explosive 126 to slip into the bore of the booster housing 160. A shoulder 172 (FIG. 6) at the interface between the booster 126 and the detonating cord 128 is adapted to contact an opposing shoulder 180 (FIG. 5) on the inner surface of the latch section after the booster 126 is slipped into the booster housing 160. Once the booster 126 is slipped into the booster housing 160 so that the opposing shoulders 172 and 180 are in contact, a retainer nut 162 may be threadably attached on the outer threaded portion 170 of the housing segments 168 to lock the booster 126 inside the booster housing 160. Effectively, a convenient snap-in attachment mechanism is provided to securely connect the booster 126 inside the booster housing 160 of the detonator assembly 22. An assembled view of the detonator assembly 22 is shown in FIG. 7. The detonator assembly 22 may then be attached inside the firing head 18 of the perforating string.

Figure 13:
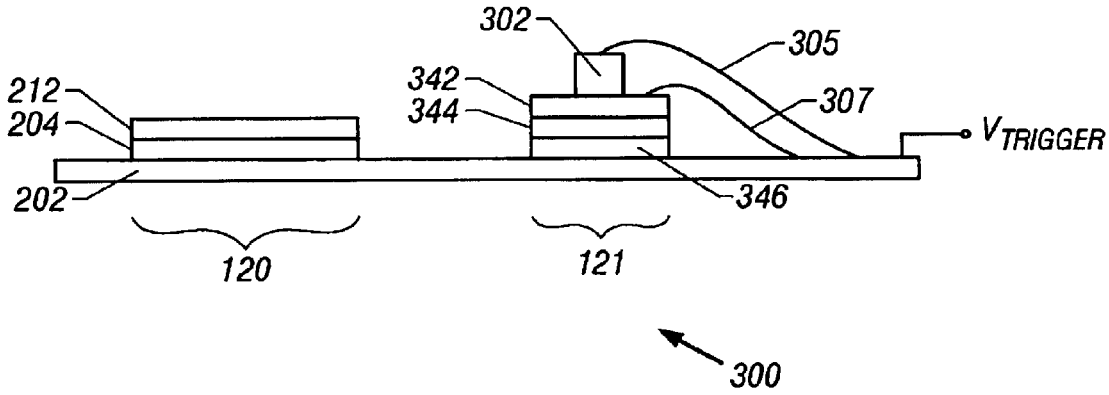
FIG. 13 illustrates an initiator device that includes an EFI circuit integrated with a switch for use in the CDU of FIG. 2.

Referring to FIG. 13, an arrangement of an initiator device 300 that includes an EPI circuit 120 integrated with a switch circuit 121 on the same support structure 202 is illustrated. The switch circuit 121 may include a plasma diode switch in accordance with an embodiment. As discussed above, the EFI circuit 120 may be composed of the lower insulator layer 202, metal foil layer 204, and upper insulator layer 212. Upon activation of the EFI circuit 120, the flyer that breaks off the upper insulator layer 212 flies through the opening 114 in the barrel 112.

The switching circuit 121 includes an upper conductor layer 342, an intermediate insulator layer 344, and a lower conductor layer 346. The upper conductor layer 342 of the switching circuit 121 is electrically coupled to one node of the slapper capacitor 106 (FIG. 2) over a wire 307. The upper conductor layer 242 also abuts a Zener diode 302. The lower conductor layer 346 is electrically coupled to one electrode of the EFI circuit 120, such as through conductive traces in the support structure 202. The diode 302 breaks down in response to an applied voltage (over a wire 305) when a trigger voltage $V_{TRIGGER}$ is activated. The applied voltage on $V_{TRIGGER}$ may be set at greater than the breakdown voltage of the diode 302, which causes it avalanches as it conducts current in response to the applied voltage, providing a sharp current rise and an explosive burst that punches through the upper conductor layer 342 and the insulation layer 344 to make an electrical connection path to the lower conductor layer 346 to close the circuit from the slapper capacitor 106 to the EFI circuit 120. This configuration is, in effect, a high-efficiency triggerable switch. There are also other switch embodiments that may be used.

The plasma switch 121 offers the advantage that it can be implemented in a relatively small package. With a smaller assembly, the ESR (effective series resistance) and ESL (effective series inductance) of the switch is reduced, which leads to enhanced efficiency of the switch. The plasma switch may also be integrated onto the same support structure as the device it connects to, such as an EFI circuit. This leads to an overall system, such as an initiator device, having reduced dimensions. By using a semiconductor material doped with a P/N junction (such as a diode) to create a plasma to form a conduction path through several layers of the switch, reliability is enhanced over conventional explosive shock switches since an explosive is not needed.

The plasma switch of FIG. 13 includes a switch 121 having a Zener diode 302 and a conductor/insulator/conductor assembly including layers 342, 344, and 346. Another embodiment of a plasma switch may employ a bridge having a narrowed section (formed of metal) that vaporizes in response to applied electrical energy.

Figure 10:
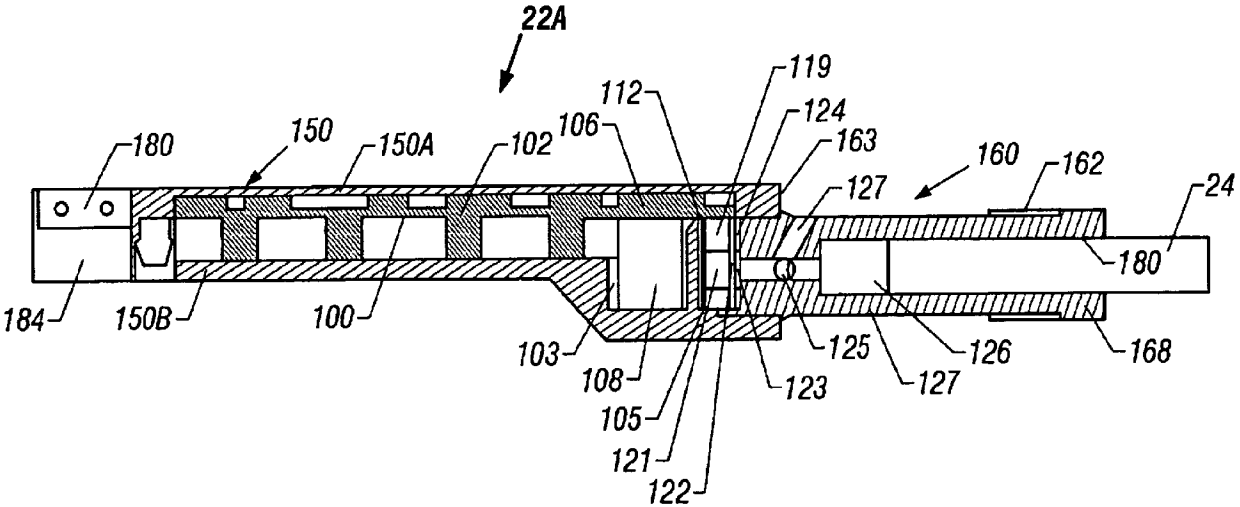
FIGS. 10–12 illustrate a detonator assembly according to another embodiment.
Figure 12:
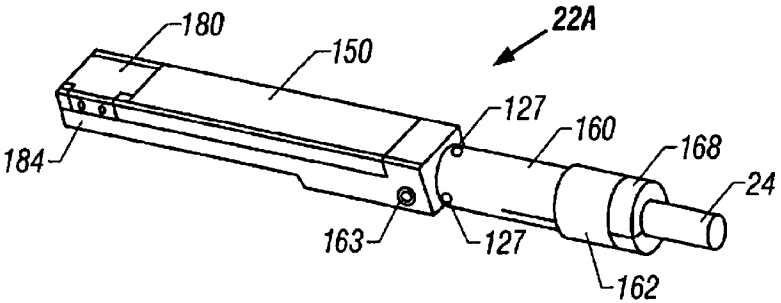
Figure 11:
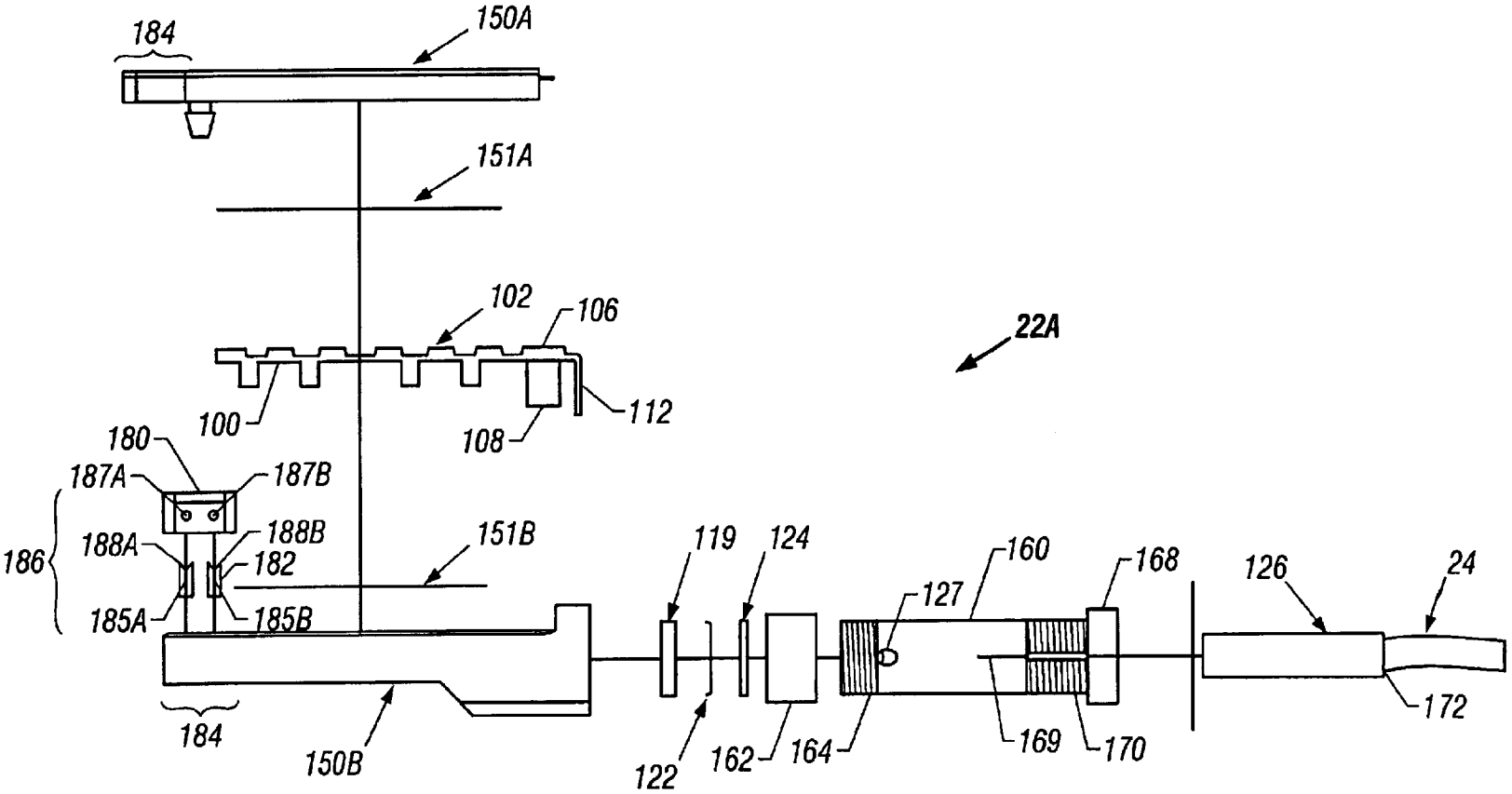

Referring to FIGS. 10–12, a detonator assembly 22A according to another embodiment is illustrated. Components of the detonator assembly 22A that are the same as the detonator assembly 22 have identical reference numerals. The detonator assembly 22A as illustrated in FIGS. 10–12 includes a main housing 150 having an extended rear portion 184 to receive an insulation displacement connector 186 that includes a wire stuffer member 180 and a pair of terminals 182 (formed of an electrically conductive metal), as shown in FIG. 11. The wire stuffer member 180 includes a pair of openings 187A and 187B to receive unstripped electrical cable wires 104A and 104B (i.e., the insulation covering remains on the cable wires 104A and 104B).

Once the wires 104A and 104B are stuffed or received in the openings 187A and 187B, respectively, the wire stuffer 180 is pushed downwards towards the terminals 182, which may be sitting in corresponding grooves in the bottom housing 150B. The slanted top edges 188A and 188B of the pair of terminals 182 are sharp to cut through the insulation cover of the wires 104A and 104B as they are driven into slots 185A and 185B, respectively, of the terminals 182. As a result, the wires 104A and 104B are electrically contacted to the terminals 182, which in turn are electrically contacted to conductive traces provided in the bottom housing 150B. This provides a convenient mechanism to plug electrical cable wires into the detonator assembly 22A.

Figure 8:
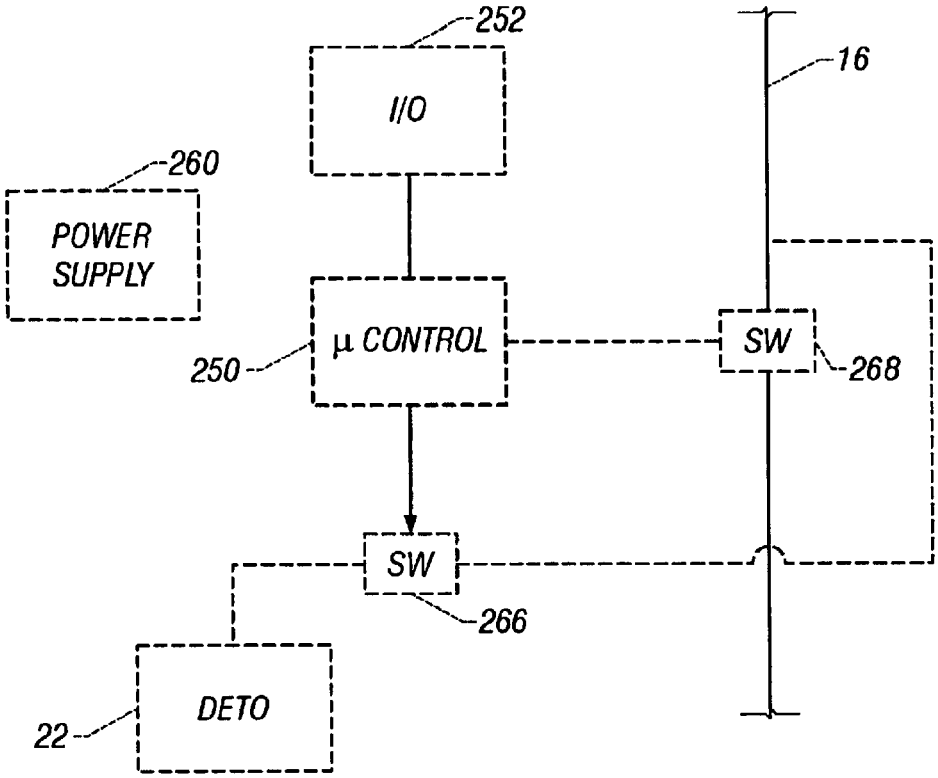
FIG. 8 illustrates a control device for use with the detonator assembly of FIG. 1.

Referring to FIG. 8, the detonator assembly 22 or 22A may be used with a control device that includes a microcontroller 250, which may be powered by a downhole power supply 260. An input/output (I/O) interface 252 may be provided between the electrical cable 16 and the microcontroller 250. Other types of controllers may be substituted for the microcontroller 250, including microprocessors, application specific integrated circuits (ASICs), programmable gate arrays (PGAs), discrete devices, and so forth. In the example embodiment illustrated in FIG. 8, the electrical cable 16 is coupled to switches 266 and 268 that may be activated or deactivated by the microcontroller 250 to control transmission of signals down the electrical cable 16. The microcontroller 250 may also be mounted on the support structure 100 with the voltage multiplier 102 and the CDU.

The microcontroller 250 is adapted to control activation and deactivation of the switches 266 and 268 in response to a command sent down the electrical cable 16, which may include address signals. When the switch 266 is turned on, a voltage on the electrical cable 16 is allowed to pass to the detonator assembly 22 or 22A. If a plurality of control devices including the microcontroller 250 and detonator assembly 22 or 22A are coupled on the electrical cable 16, the switches 266 and 268 can be controlled to selectively activate control devices by addressing commands to the control devices in sequence. This allows firing of a sequence of perforating strings in a desired order. Selective activation of a sequence of tool strings is described in commonly assigned copending U.S. patent application Ser. No. 09/179,507, filed Oct. 27, 1998, entitled "Downhole Activation System," which is hereby incorporated by reference.

While the invention has been disclosed with respect to a limited number of embodiments, those skilled in the art will appreciate numerous modifications and variations therefrom. It is intended that the appended claims cover all such modifications and variations as fall within the true spirit and scope of the invention.

What is claimed is:

1. A detonator assembly for use with an explosive device, comprising:

a support structure;

an exploding foil initiator mounted on the support structure;

a switch mounted on the support structure adapted to be activated to couple electrical energy to the exploding foil initiator; and an opening formed in the support structure adjacent the exploding foil initiator, the opening adapted to receive an initiating element of the exploding foil initiator.

2. The detonator assembly of claim 1, wherein the opening is formed in a first portion of the support structure that is angled relative to a second portion of the support structure.

3. The detonator assembly of claim 1, wherein the initiating component includes a flyer from the exploding foil initiator.

4. The detonator assembly of claim 1, wherein the initiating element includes a bubble from the exploding foil initiator.

5. The detonator assembly of claim 1, wherein the support structure includes a flexible support structure.

6. The detonator assembly of claim 5, wherein the support structure includes a flex cable.

7. The detonator assembly of claim 1, further comprising a capacitor mounted on the support structure, the switch being coupled between the capacitor and exploding foil initiator.

8. The detonator assembly of claim 7, wherein the capacitor stores the electrical energy.

9. The detonator assembly of claim 7, wherein the capacitor includes a dielectric formed of a ceramic material.

10. The detonator assembly of claim 1, further comprising a substrate on which the exploding foil initiator is formed, wherein the switch is also formed on the substrate.

11. The detonator assembly of claim 1, further comprising one or more housings in which the support structure is mounted and an explosive positioned in the one or more housings and adapted to be initiated by the explosive foil initiator.

12. The detonator assembly of claim 11, further comprising a detonating cord, wherein initiation of the detonating cord is caused by detonation of the explosive, at least a portion of the detonating cord being contained in the one or more housings.

13. The detonator assembly of claim 1, further comprising an explosive positioned proximal the opening.

14. The detonator assembly of claim 13, further comprising a layer positioned adjacent the explosive, at least a portion of the layer adapted to be sheared upon detonation of the explosive.

15. The detonator assembly of claim 14, further comprising a booster explosive and a gap between the booster explosive and the layer, the booster explosive adapted to be detonated by impact of the sheared layer portion.

16. The detonator assembly of claim 15, further comprising a detonating cord coupled to the booster explosive.

17. The detonator assembly of claim 13, wherein the layer includes a metal.

18. The detonator assembly of claim 13, wherein the explosive includes a NONA explosive.

19. A detonator assembly for use with an explosive tool, comprising:

an energy source;

an exploding foil initiator;

a switch coupling the energy source to the exploding foil initiator; and a support structure on which the energy source, exploding foil initiator, and switch are mounted, wherein an opening is formed in the support structure proximal the exploding foil initiator to receive an initiating element of the exploding foil initiator.

20. The detonator assembly of claim 19, wherein the energy source includes a capacitor.

21. The detonator assembly of claim 19, wherein the support structure includes a flexible support structure.

22. The detonator assembly of claim 21, wherein the flexible support structure includes a flex cable.

23. The detonator assembly of claim 19, wherein the support structure has a first segment and a second segment at an angle from the first segment, the opening formed in the second segment and the exploding foil initiator mounted on the second segment.

24. A downhole tool for use in a well, comprising:

a detonator assembly including an exploding foil initiator and a housing having a latch portion;

a booster explosive, the housing having a chamber adapted to receive the booster explosive, and the latch portion adapted to engage the booster explosive, wherein the exploding foil initiator is positioned proximal the booster explosive so that an initiator element from the exploding foil initiator is able to impact the booster explosive.

25. The downhole tool of claim 24, wherein the housing includes a plurality of segments separated by slits, the chamber formed at least in part by a portion of the housing including the plurality of segments.

26. A downhole tool for use in a well, comprising:

a detonator assembly including an exploding foil initiator and a housing having a latch portion; and a booster explosive, the housing having a chamber adapted to receive the booster explosive, and the latch portion adapted to engage the booster explosive, wherein the housing includes a plurality of segments separated by slits, the chamber formed at least in part by a portion of the housing including the plurality of segments, wherein external surfaces of the segments form a threaded portion, the downhole tool further comprising a retainer nut adapted to engage the threaded portion to lock the booster explosive in the housing.

27. The downhole tool of claim 24, wherein an engagement surface is formed in an inner wall of the housing, and wherein an opposing surface is formed in the booster, the surfaces of the housing inner wall and the booster being adapted to engage.

28. A detonator assembly activable by signals in one or more electrical wires, comprising:

an initiator; and a housing containing the initiator and an insulation displacement connector adapted to electrically receive the one or more electrical wires.

29. The detonator assembly of claim 28, wherein the insulation displacement connector includes a wire receiving member.

30. The detonator assembly of claim 29, wherein the insulation displacement connector further includes one or more sharp edges adapted to strip insulation from corresponding one or more wires when the receiving member is pushed in a predetermined direction.

31. The detonator assembly of claim 30, further comprising one or more electrically conductive terminals to receive exposed conductors of the one or more wires.

32. The detonator assembly of claim 31, wherein the one or more sharp edges are formed on the one or more terminals.

33. Apparatus for initiating an explosive device, comprising:

a support structure having a first segment and a second segment the first and second segments being angled with respect to each other;

an energy source mounted on the first segment; and an exploding foil initiator mounted on the second segment.

34. The apparatus of claim 33, wherein the first and second segments are integrally attached.

35. A detonator assembly, comprising:

one or more housings;

an explosive contained in the one or more housings;

a flexible support structure having a first portion angled with respect to another portion of the support structure, the flexible support structure mounted in the one or more housings; and an initiator mounted on the first portion to orient the initiator towards the explosive.

36. A method of making a detonator assembly, comprising:

providing a support structure having a first segment and a second segment;

providing the first segment generally perpendicularly to the second segment;

mounting an energy source on the first segment; and mounting an exploding foil initiator on the second segment.

37. The method of claim 36, further comprising forming an opening in the second segment adjacent the exploding foil initiator to receive a flyer from the exploding foil initiator.

38. The method of claim 36, further comprising placing the support structure in one or more housings.

39. The method of claim 38, further comprising mounting an explosive in the one or more housings in the proximity of the exploding foil initiator.

40. The detonator assembly of claim 1, wherein the switch is adapted to be activated by a voltage.

41. The detonator assembly of claim 40, wherein the switch when inactive blocks the electrical energy from the exploding foil initiator.

42. The detonator assembly of claim 2, wherein the switch is mounted on the second portion of the support structure.

43. The detonator assembly of claim 42, wherein the exploding foil initiator is mounted on the first portion.

44. The detonator assembly of claim 2, wherein the first portion is generally perpendicular to the second portion.

45. The detonator assembly of claim 35, wherein an opening is formed in the first portion to receive an initiator element from the initiator.

* * * * *